United States Patent [19]

Roark

[11] Patent Number: 4,468,026

[45] Date of Patent: Aug. 28, 1984

[54] LEG EXERCISE APPARATUS WITH ELEVATED STAND AND LOWER LINE GUIDING MEMBER

[76] Inventor: Carl D. Roark, P.O. Box 375, Cassville, Mo. 65625

[21] Appl. No.: 372,987

[22] Filed: Apr. 29, 1982

[51] Int. Cl.[3] ..... A63B 21/12

[52] U.S. Cl. ..... 272/136; 272/144

[58] Field of Search ..... 272/134, 135, 136, 143, 272/900, 138, 139, 97, 117, 144

[56] References Cited

U.S. PATENT DOCUMENTS

| | | | |
|---|---|---|---|
| 418,257 | 12/1889 | Whitely | 272/136 |
| 679,784 | 8/1901 | Ryan | 272/900 X |
| 3,752,474 | 8/1973 | Macabet et al. | 272/97 X |
| 4,026,548 | 5/1977 | Birdwell | 272/900 X |

FOREIGN PATENT DOCUMENTS

| | | | |
|---|---|---|---|
| 384435 | 2/1965 | Switzerland | 272/117 |
| 628340 | 8/1949 | United Kingdom | 272/136 |

*Primary Examiner*—Richard T. Stouffer
*Assistant Examiner*—William H. Honaker
*Attorney, Agent, or Firm*—Boyd David Cox

[57] ABSTRACT

An improved exercise apparatus comprising an elevated stand having at least one line guiding member lateral thereto, a line held by said line guiding member, said line having a device for body attachment at one end thereof with the other end being attached to a device for creating tension, the tension creating device having an anchoring device generally opposite the point of line attachment.

6 Claims, 3 Drawing Figures

LEG EXERCISE APPARATUS WITH ELEVATED STAND AND LOWER LINE GUIDING MEMBER

BACKGROUND OF THE INVENTION

The present invention relates to physical fitness and a means whereby particular muscles or muscle groups may be strengthened and developed. In addition, it relates to a means whereby toning of certain areas of the body may be achieved, as well as the exercising of the cardiovascular system.

Many exercises and pieces of equipment have been introduced to isolate particular muscles or muscle groups so that they may be specifically worked. However, no conventional exercise or piece of equipment allows for an efficient and effective exercising of the calf, hamstring, and buttock muscles. In those instances where mechanical devices have been designed to exercise such muscles (but in a manner different than with this invention), they are so cumbersome and costly as to usually be found only in health clubs and gymnasiums. Thus, a person waiting to attempt to strengthen and develop such muscles must have access to such establishment and commute there in order to do so.

SUMMARY OF THE INVENTION

The primary object of the present invention is to provide an improved exercise apparatus whereby the calf, hamstring and buttock muscles may be efficiently and effectively exercised.

It is also an object of the present invention to provide an exercise apparatus which is relatively inexpensive, portable, lightweight and easy to use.

Another object of the present invention is the provision of an exercise apparatus which applies constant tension (constant meaning continuous and not equal in magnitude) to the muscles or muscle groups being worked which results in a more beneficial exercise than without such constant tension.

Still another object of this invention is to provide an exercise apparatus which allows for a full extension of the leg as well as a full range of motion thereof, such that full benefit may be attained from the constant tension applied to specific muscles being exercised.

An additional object of this invention is the provision of an exercise apparatus which may be used for a number of exercises other than the one for which it is primarily designed.

DETAILED DESCRIPTION

Figure 1:
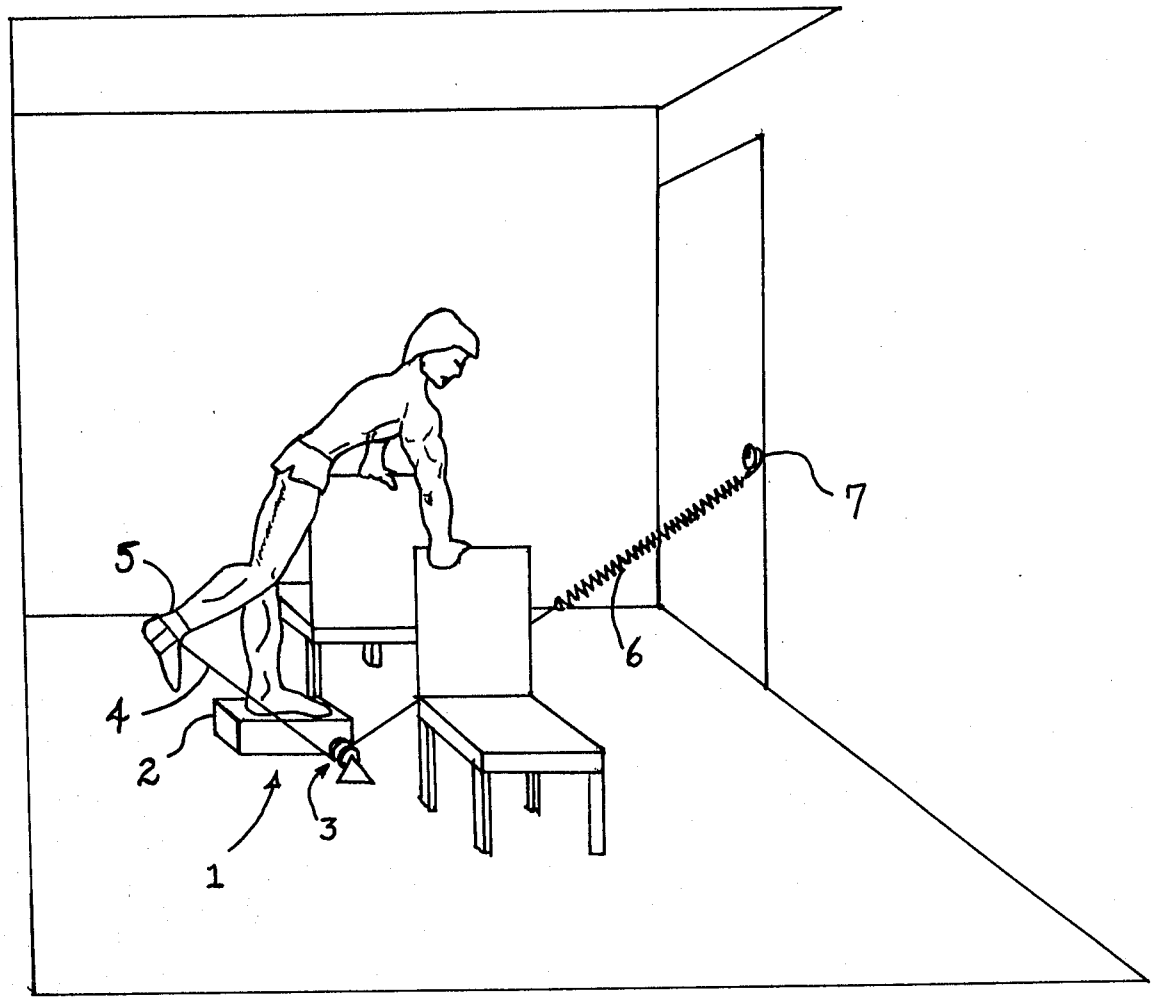
FIG. 1 is a perspective view illustrating the exercise apparatus of the present invention in use.
Figure 2:
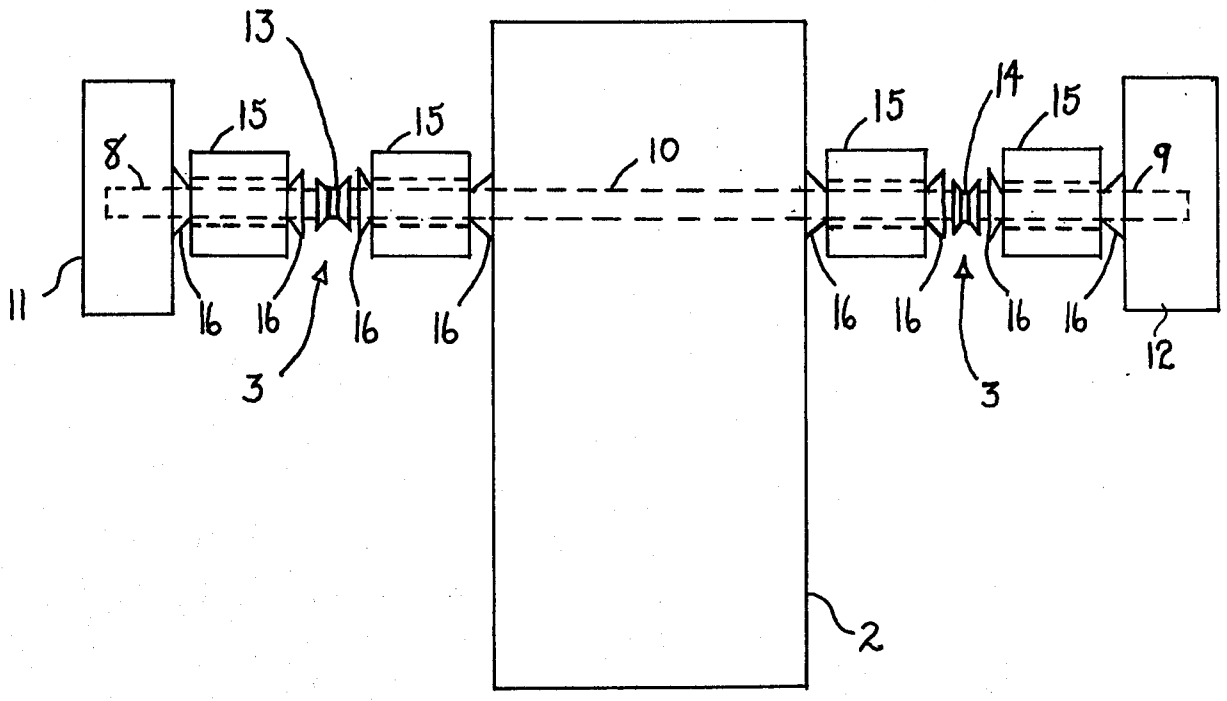
FIG. 2 is a top view of part of the exercise apparatus of this invention.
Figure 3:
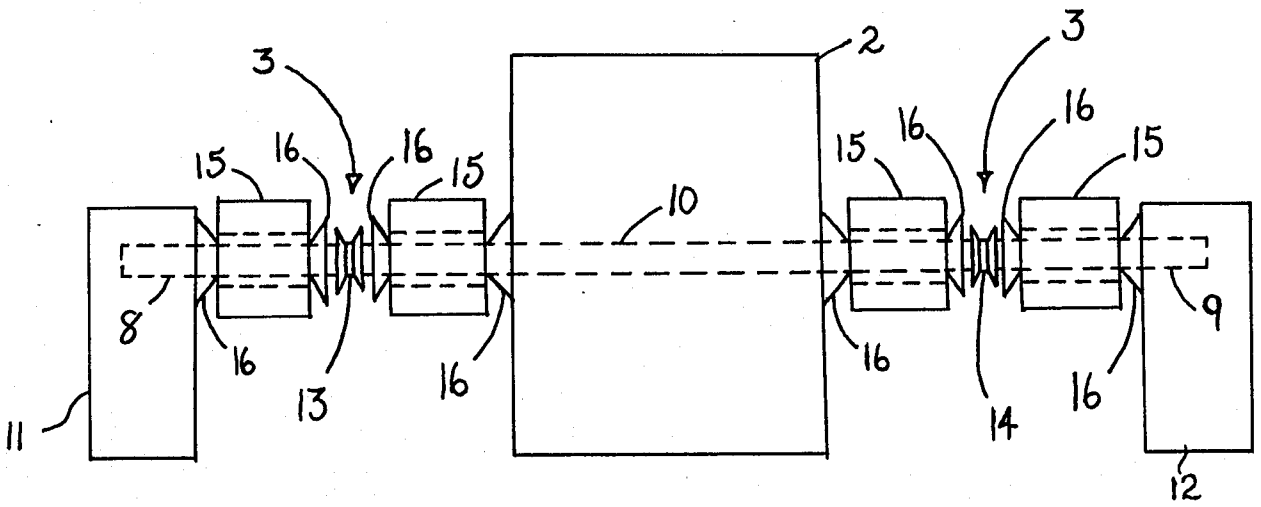
FIG. 3 is a front view of part of the exercise apparatus of this invention.

A preferred embodiment of the present invention is shown in use in FIG. 1. An individual is standing on the improved exercise apparatus generally designated 1. Such exercise apparatus 1 part of which is illustrated in more detail in FIGS. 2 and 3 comprises an elevated stand 2, line guiding members generally designated 3 on each side of such elevated stand 2, a line 4 which is shown held by one of such line guiding members 3 in FIG. 1, such line 4 having body attachment means 5 at one end thereof with the other end being attached to tension creating means 6, such tension creating means 6 having anchoring means 7 generally opposite the point of line 4 attachment.

The materials of construction of the improved exercise apparatus 1 may be of any suitable type such as wood, metal, plastic, other synthetic material or a combination thereof, although they preferrably should be as lightweight and strong as possible and will be readily apparent to one skilled in the art of manufacture of such type items.

The line guiding members 3 of this preferred embodiment comprise (see FIGS. 2 and 3) the respective end portions 8 and 9 of a rod 10 which passes through said elevated stand 2 at the front middle portion thereof, as well as base members 11 and 12 which receive and support the end portions 8 and 9 of rod 10, and pulleys 13 and 14 located on said rod 10 approximately midway between the respective sides of elevated stand 2 and the respective end points of rod 10, with padded rollers 15 being positioned on rod 10 proximate said pulleys 13 and 14 and on either side thereof. In addition, washers 16 are provided as spacers on rod 10 between bases 11 and 12 and rollers 15, rollers 15 and pulleys 13 and 14, and rollers 15 and the sides of elevated stand 2.

It is noted that in this preferred embodiment of the present invention, two line guiding members 3 are provided, one on each side of elevated stand 2, as a matter of convenience for one exercising with the apparatus. Only one such line guiding member 3 is necessary to the apparatus of the invention. For instance, an improved exercise apparatus could be provided with one line guiding member 3 on the right side of elevated stand 2 for exercising of right parts of the body and another improved exercise apparatus provided with one line guiding member 3 on the left side of an elevated stand 2 for exercising left parts of the body. Additionally, an apparatus could be constructed such that the elevated stand 2 could be turned over to position a line guiding member 3 from its right side to left or vice versa, affording an exerciser the opportunity to exercise both right and left parts of the body. Furthermore, the elevated stand 2 and line guiding member 3 could be separate or detachable such that their configuration could be readily changed.

Pulleys 13 and 14 are provided to facilitate the movement of line 4 as it passes under a line guiding member 3 during performance of exercises with improved exercise apparatus 1. Such pulleys are not necessary, only desirable, since the primary function of line guiding members 3 is to keep line 4 in alignment during use of such apparatus 1. Line guiding members of simpler construction could be used, such as a rod with a groove to receive line 4 or a hook or ring to receive such line 4.

Padded rollers 15, which have a radius greater than pulleys 13 and 14, are provided for safety and comfort to aid in keeping parts of the body out of contact with other parts of the line guiding members 3 when exercising with apparatus 1.

Base members 11 and 12 support rod 10 in this preferred embodiment and lend stability to elevated stand 2 and apparatus 1 as a whole. Of significant importance is that base members 11 and 12 prevent tipping of elevated stand 2 when exercises are being performed. With this and other arrangements of elevated stand 2 and line guiding members 3 as discussed above stability could be assured by fixing elevated stand 2 to the floor.

Line 4 of the present invention is preferrably a strong, pliable cord or rope of natural or synthetic material. Body attachment means 5 at one end thereof may be as simple as a loop in line 4 or a more elaborate arrangement as shown in FIG. 1 comprising a harness that in this case fastens around the foot, slightly above the ankle, with a loop on the front thereof that receives a hook or clip attached to the end of line 4.

Tension creating means 6 of this preferred embodiment comprise a spring. However, such tension creating means may be of any suitable type as long as an individual can adequately exercise with the apparatus of the invention. Interchangable springs of differing sizes may be used to afford variation in the tension created by apparatus 1. Additionally, springs may be arranged in parallel or in series for the same purpose. Such variations allow exercisers of differing strengths to effectively and efficiently utilize the apparatus, as well as allowing an individual exerciser to increase the tension of apparatus 1 as his strength increases through the use thereof.

Anchoring means 7 at the end of tension creating means 6 generally opposite the point of line 4 attachment may simply be a loop of suitable material which can be placed around a door knob (as shown in FIG. 1) or other adequate support so that tension may be created by pulling on tension creating means 6 at the point of line 4 attachment.

It is noted that line 4 could incorporate tension creating means 6. That is, line 4 could be made of an elastic material such that once anchored, a pulling force directed thereto would be resisted by tension created by the elastic material itself. In such event, line 4 and the tension creating means thereof could even be anchored to line guiding means 3.

In practice, an individual attaches the anchoring means 7 to a suitable support, such as a doorknob, runs line 4 through line guiding means 3 and attaches such line 4 to his leg slightly above the ankle via body attachment means 5. Line attachment is preferred slightly above the ankle so that the bending of such joint does not influence the performance of the exercise. Then standing on elevated stand 2, facing the front thereof, and preferrably bracing himself against a wall or other suitable object, he begins an exercise for the calf, hamstring, and buttock muscles by initially having the leg to which line 4 is attached extended downward lateral to the top of the elevated stand 2 and gradually pulling the foot of that leg simultaneously backward and upward against the tension created by tension creating means 6 while bending such leg at the knee. After taking his foot in such manner as far back and up as possible, he then brings his leg back to its initial extended position while resisting the pulling action exerted against his leg by such tension creating means 6. This procedure is performed through a number of repetitions until the aforementioned muscles are well exercised. Line 4 is then detached from the leg of the individual, moved to the line guiding means 3 on the opposite side of elevated stand 2, attached to the other leg of the individual and the exercise is duplicated with such leg.

In such manner, the individual is able to efficiently and effectively strengthen and develop the calf, hamstring and buttock muscles of his body. Improved exercise apparatus 1 affords a particularly beneficial exercise due to the constant tension it applies to the muscles being worked. By not allowing the muscles to relax, they are better exercised. It is noted that preferrably the apparatus is assembled such that when the individual has his leg extended, tension creating means 6 exert a pulling force on his leg. Initially, this force is directed toward line guiding means 3 and is prevalent as the foot is brought backward and upward and as it is returned to its original position. By pulling against the force in bringing the foot back and up and then resisting the force in returning the foot to its original position, an individual realizes maximum benefit from the exercise. The elevated platform 2 promotes the constant tension due to the fact that the leg being exercised is actually suspended and not allowed to touch any surface during the exercise, thereby preventing the muscles being worked from resting until completion of the exercise.

As noted earlier, this improved exercise apparatus 1 may be used for other exercises than the one just described. For instance, an individual can hold line 4 in his hand or attach such line 4 to his wrist and perform an arm exercise commonly referred to as a curl by initially extending his arm downward and then pulling his hand upward, bending at the elbow, and finally returning to the original extended arm position. Other such exercises may be developed by individual exercisers depending upon their particular needs and desires.

It is understood that the present invention is not limited to that precisely as described hereinabove. Many modifications and variations of this invention will be apparent to those skilled in the art. It is, therefore, intended that the scope of the invention be solely limited by the claims appended hereto.

I claim:

1. An improved exercise apparatus for exercise of the leg comprising an elevated stand having a top surface and side portions extending downwardly therefrom, for a person to position one foot upon such that the other foot, which is of the leg to be exercised, is suspended lateral to said stand, such stand having at least one line guiding member, said line guiding member being positioned laterally on at least one side portion and lower than the top surface of said stand, a line held by said line guiding member, said line having body attachment means at one end thereof with the other end being attached to tension creating means, said tension creating means having anchoring means generally opposite the point of line attachment.

2. The improved exercise apparatus of claim 1 wherein said line guiding member comprises a pulley.

3. The improved exercise apparatus of claim 2 wherein said pulley has roller pads of a radius greater than said pulley proximate each side thereof.

4. The improved exercise apparatus of claim 1 wherein said tension creating means comprise a spring.

5. The improved exercise apparatus of claim 1 wherein said body attachment means comprise ankle attachment means.

6. The improved exercise apparatus of claim 1 wherein the line incorporates the tension creating means.

* * * * *